US006327880B1

(12) United States Patent
Liang

(10) Patent No.: US 6,327,880 B1
(45) Date of Patent: Dec. 11, 2001

(54) DOOR LOCK DEVICE

(76) Inventor: Chia-Pei Liang, No. 117, tzeng fwu Alley, tzeng tsuoh village, shiow shu shiang, Changhua (TW)

( * ) Notice: Subject to any disclaimer, the term of this patent is extended or adjusted under 35 U.S.C. 154(b) by 0 days.

(21) Appl. No.: 09/455,942

(22) Filed: Dec. 7, 1999

(51) Int. Cl.[7] ..... E05B 63/08

(52) U.S. Cl. ..... 70/106; 70/150; 70/470; 70/478; 70/479; 70/484; 282/142

(58) Field of Search ..... 70/106, 107, 110, 70/467–470, 477–485, 150; 292/142

(56) References Cited

U.S. PATENT DOCUMENTS 1,184,766 * 5/1916 Mihel ..... 70/110
1,387,245 * 8/1921 Dowling ..... 70/106
1,675,041 * 6/1928 Nakahara ..... 70/110
2,648,969 * 8/1953 Miller et al. ..... 70/485
3,172,281 * 3/1965 Tugle ..... 70/479
4,418,552 * 12/1983 Nolin ..... 70/110 X
4,594,864 * 6/1986 Hart ..... 70/479 X
4,606,203 * 8/1986 Esser ..... 70/107
4,864,835 * 9/1989 Wartian ..... 70/110 X

* cited by examiner

*Primary Examiner*—Llyod A. Gall
(74) *Attorney, Agent, or Firm*—Bacon & Thomas PLLC

(57) ABSTRACT

A door lock device is disposed on a door (1). The door (1) has an upper through hole (11) and a lower through hole (12). The door lock device has a latch bolt device (6) disposed on the door (1), a case frame (2) having an upper hollow cylinder (22) inserted through the upper through hole (11) and a lower hollow cylinder (23) inserted through the lower through hole (12), a first pressing plate (8) disposed on the case frame (2), a core (3) disposed in the upper hollow cylinder (22), a lock fastener device (4) disposed in the upper hollow cylinder (22), and a drive mechanism (5) disposed in the upper hollow cylinder (22). The drive mechanism (5) has a rack (53) to drive the latch bolt device (6). A locking plate (71) covers the upper through hole (11) and the lower through hole (12). A decoration plate (72) is disposed on the locking plate (71). A second pressing plate (8') is disposed on the decoration plate (72).

2 Claims, 11 Drawing Sheets

DOOR LOCK DEVICE

FIELD OF THE INVENTION

The present invention relates to a door lock device. More particularly, the present invention relates to a door lock device which is detached easily.

DESCRIPTION OF THE RELATED ART

A conventional door lock device has a dead bolt and a latch bolt. However, the latch bolt will block a door while the door is opened. Furthermore, a doorknob is often protruded from an outer face of the door. Thus a child may bump into the doorknob accidentally. If a core of the conventional door lock device is broken, the whole door lock device should be replaced.

SUMMARY OF THE INVENTION

An object of the present invention is to provide a door lock device which can be disassembled easily. Thus a core of the door lock device can be replaced easily.

Another object of the present invention is to provide a door lock device which has a case frame having an upper hollow cylinder inserted through an upper through hole of a door and a lower hollow cylinder inserted through a lower through hole of the door so that an outer face of the case frame can contact an outer face of the door flatly.

Another object of the present invention is to provide a door lock device which has a drive mechanism having a rack to drive a latch bolt device so that the latch bolt device will not block a door while the door is opened.

Another object of the present invention is to provide a door lock device which has a torsion spring to force a first pressing plate contacting a case frame while the first pressing plate is not operated.

DETAILED DESCRIPTION OF THE PREFERRED EMBODIMENTS

Figure 1:
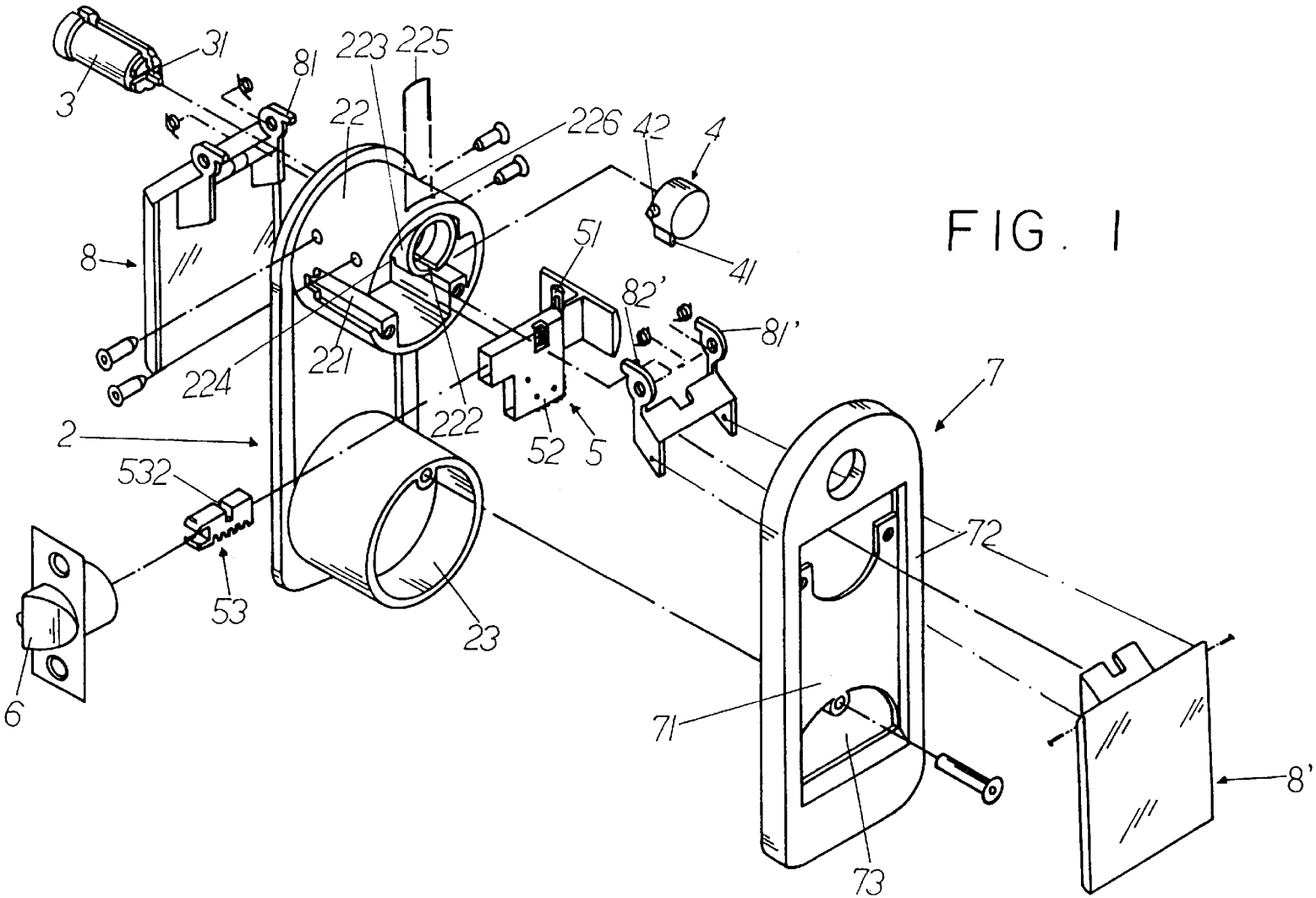
FIG. 1 is a perspective exploded view of a door lock device of a preferred embodiment in accordance with the present invention.
Figure 2:
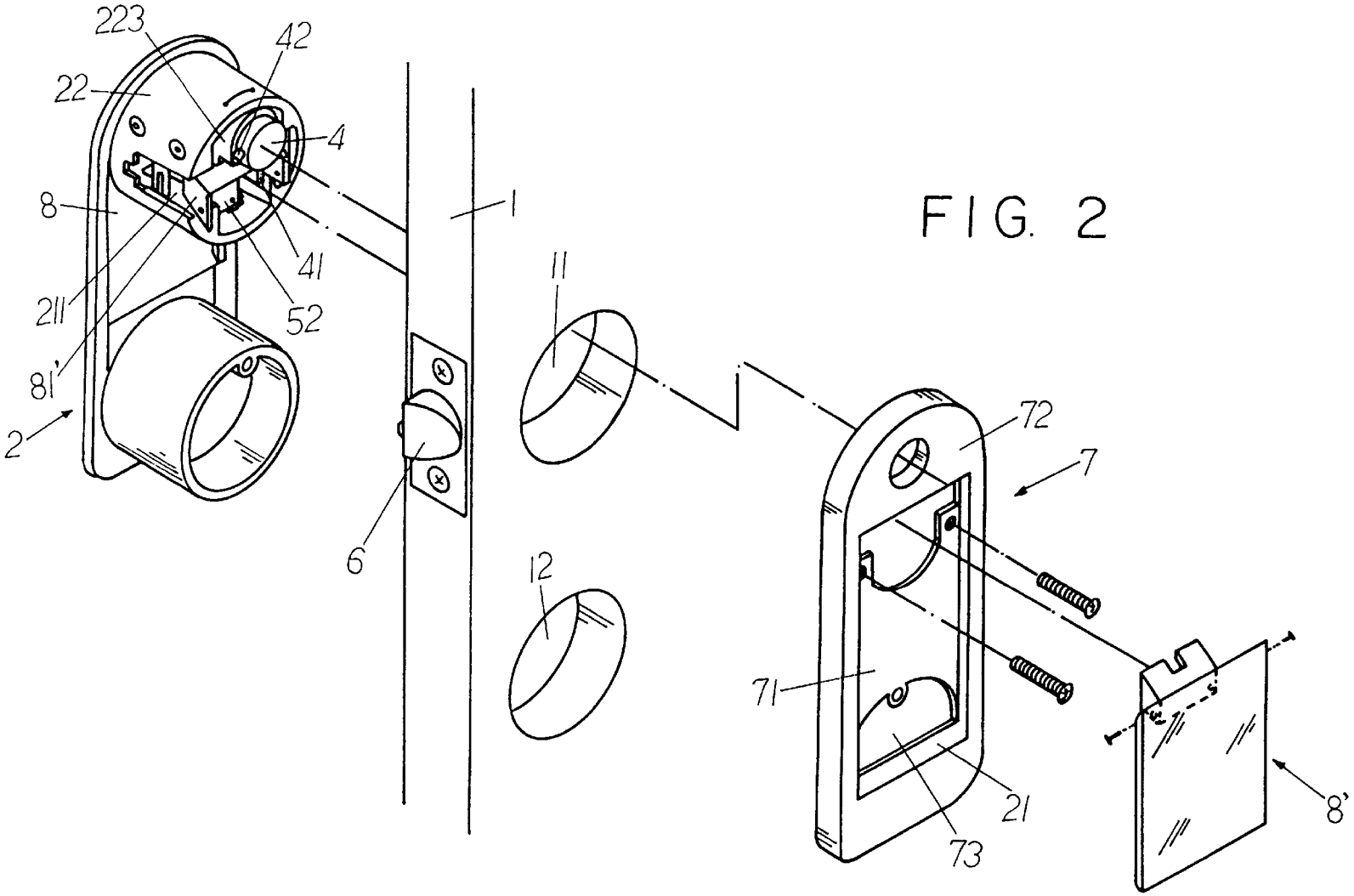
FIG. 2 is a perspective exploded view of a case frame, a latch bolt device, a decoration plate, and pressing plate.

Referring to FIGS. 1 to 7B, a door lock device is disposed on a door 1. The door 1 has an upper through hole 11 and a lower through hole 12. The door lock device includes a latch bolt device 6 disposed on the door 1, a case frame 2 having an upper hollow cylinder 22 inserted through the upper through hole 11 and a lower hollow cylinder 23 inserted through the lower through hole 12, a first pressing plate 8 disposed on the case frame 2, and a drive mechanism 5 disposed in the upper hollow cylinder 22.

The case frame 2 further has a recess 21. A core 3 has a driven block 31. A lock fastener device 4 has a lateral elastic block 42 and a blocking bar 41.

The upper hollow cylinder 22 has an inner groove 222, a lateral slot 221, and a core seat 223 receiving the core 3 and the lock fastener device 4. The core seat 223 has a bottom hole 224.

The drive mechanism 5 has a rack 53 to drive the latch bolt device 6, and a drive frame 51 having a gear set 52 to drive the rack 53. The rack 53 has an upper groove 532. The rack 53 passes through the lateral slot 221 to connect to the latch bolt device 6. A pressing device 81' is disposed in the upper hollow cylinder 22 to connect to the drive frame 51. The pressing device 81' has a protruded block 82'.

The blocking bar 41 is inserted in the upper groove 532. A compression spring S is disposed between the drive frame 51 and the rack 53. A torsion spring S1 is disposed between the core 3 and the lock fastener device 4.

The first pressing plate 8 has an upper pressing portion 81. The recess 21 receives the first pressing plate 8.

A locking plate 71 covers the upper through hole 11 and the lower through hole 12.

A decoration plate 72 is disposed on the locking plate 71. The decoration plate 72 has an opening 73. A second pressing plate 8' is disposed on the decoration plate 72. The opening 73 receives the second pressing plate 8'. An upper portion of the second pressing plate 8' is connected to the pressing device 81'.

Figure 3B:
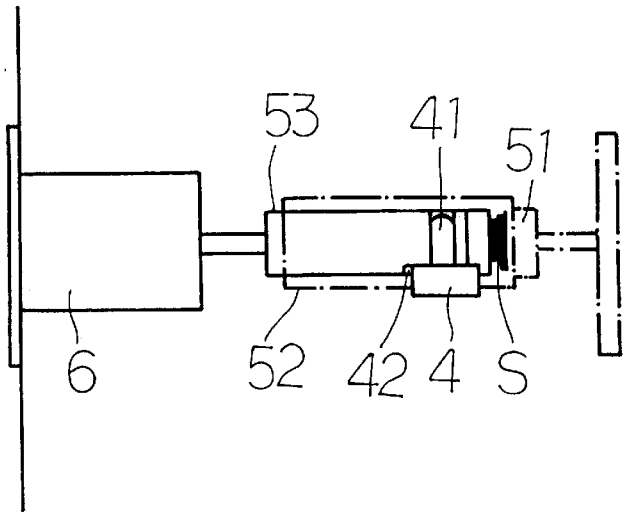
FIG. 3B is another schematic view illustrating an engagement of a latch bolt device and drive mechanism.
Figure 3A:
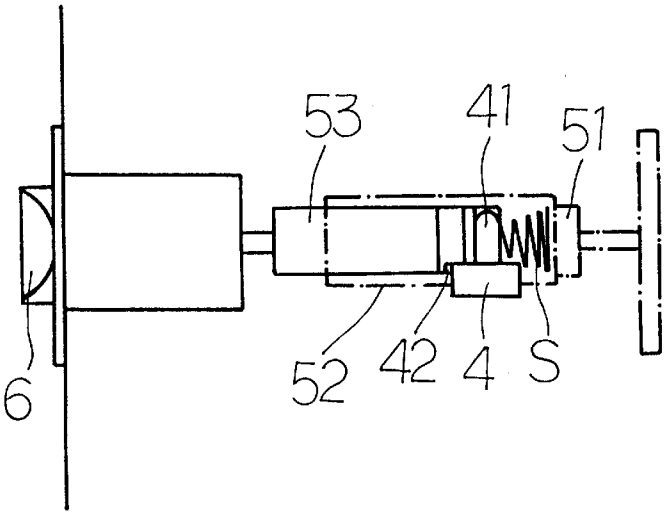
FIG. 3A is a schematic view illustrating an engagement of a latch bolt device and a drive mechanism.

The compression spring S pushes the latch bolt device 6 to extend (as shown in FIG. 3A). When the compression spring S is compressed, the latch bolt device 6 retracts (as shown in FIG. 3B).

Figure 4A:
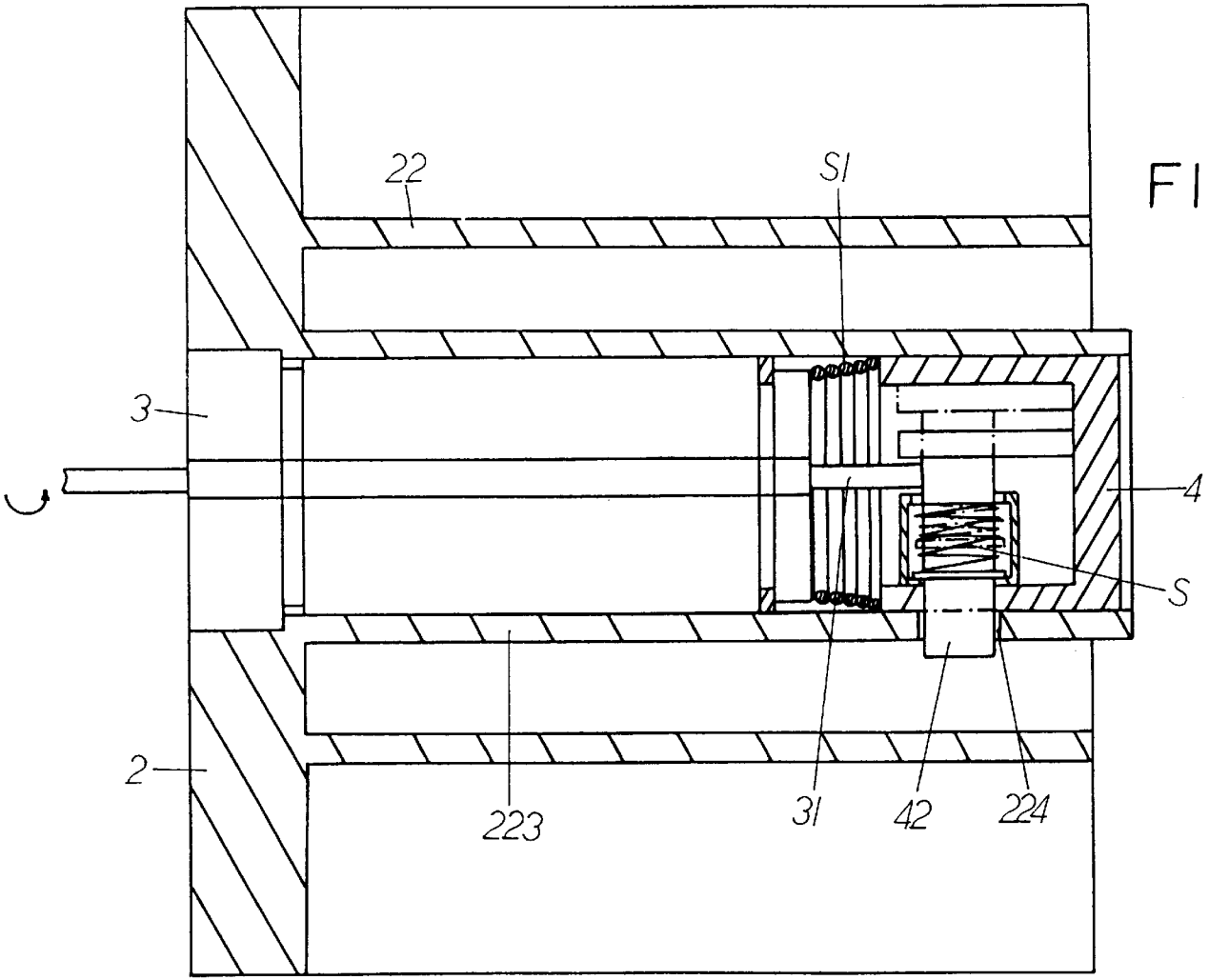
FIG. 4A is a schematic view illustrating an application of a door lock device while the door lock device is locked.
Figure 6A:
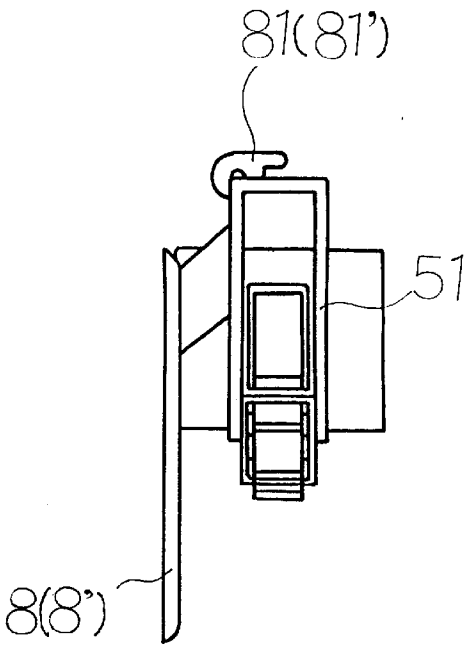
FIG. 6A is a schematic view illustrating a first pressing plate disposed on a case frame while the first pressing plate is not operated.
Figure 6B:
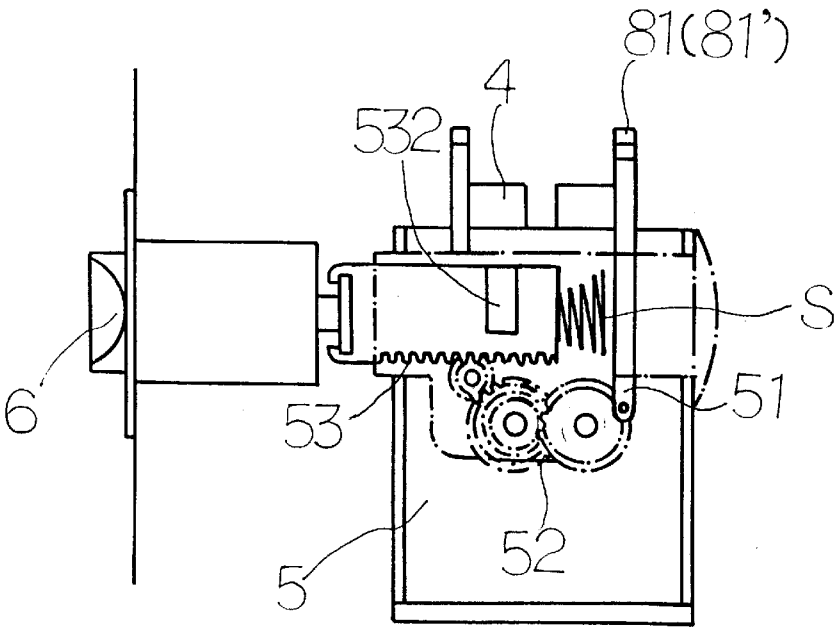
FIG. 6B is a saschematic view illustrating a drive mechanism driving a latch bolt device to extend.
Figure 7A:
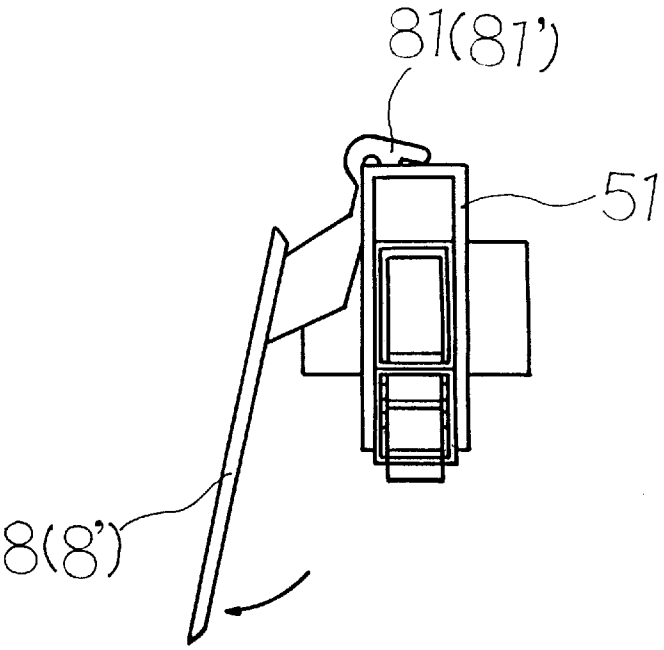
FIG. 7A is a schematic view illustrating a first pressing plate disposed on a case frame while the first pressing plate is operated.
Figure 7B:
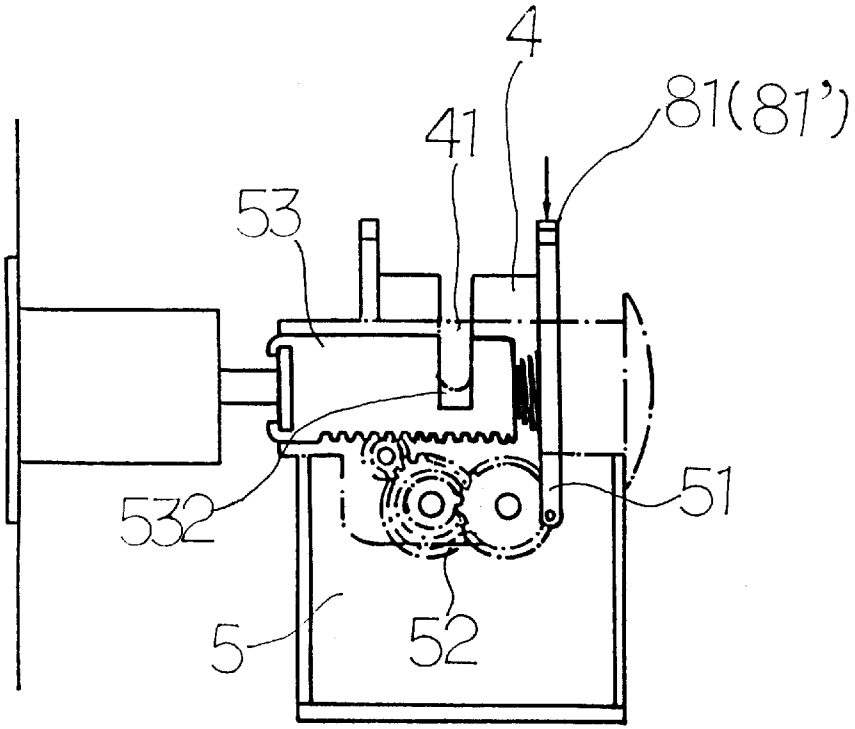
FIG. 7B is a schematic view illustrating a drive mechanism driving a latch bolt device to retract.

Referring to FIG. 6B, the blocking bar 41 is inserted in the upper groove 532. The lateral elastic block 42 is inserted in the bottom hole 224 (as shown in FIG. 4A). Since the blocking bar 41 is inserted in the upper groove 532, the latch bolt device 6 locks the door 1.

Figure 5:
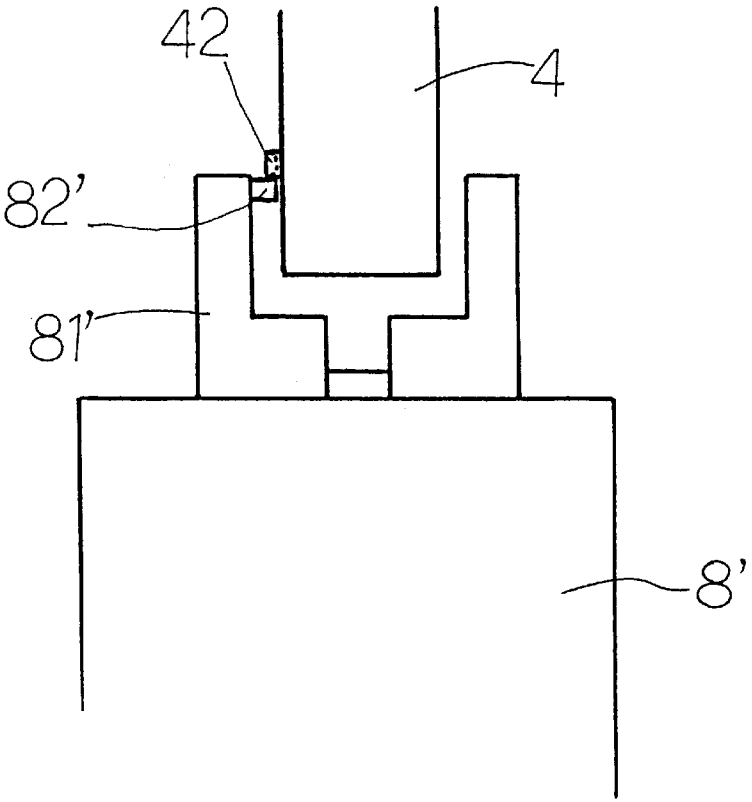
FIG. 5 is a schematic view illustrating an engagement of a protruded block of a pressing device and an elastic block of a lock fastener device.

When the second pressing plate 8' is operated, the protruded block 82' contacts the lateral elastic block 42 to force the lateral elastic block 42 to retract (as shown in FIG. 5). When the core 3 is rotated to contact the lateral elastic block 42, the core 3 forces the lateral elastic block 42 to retract.

Figure 4B:
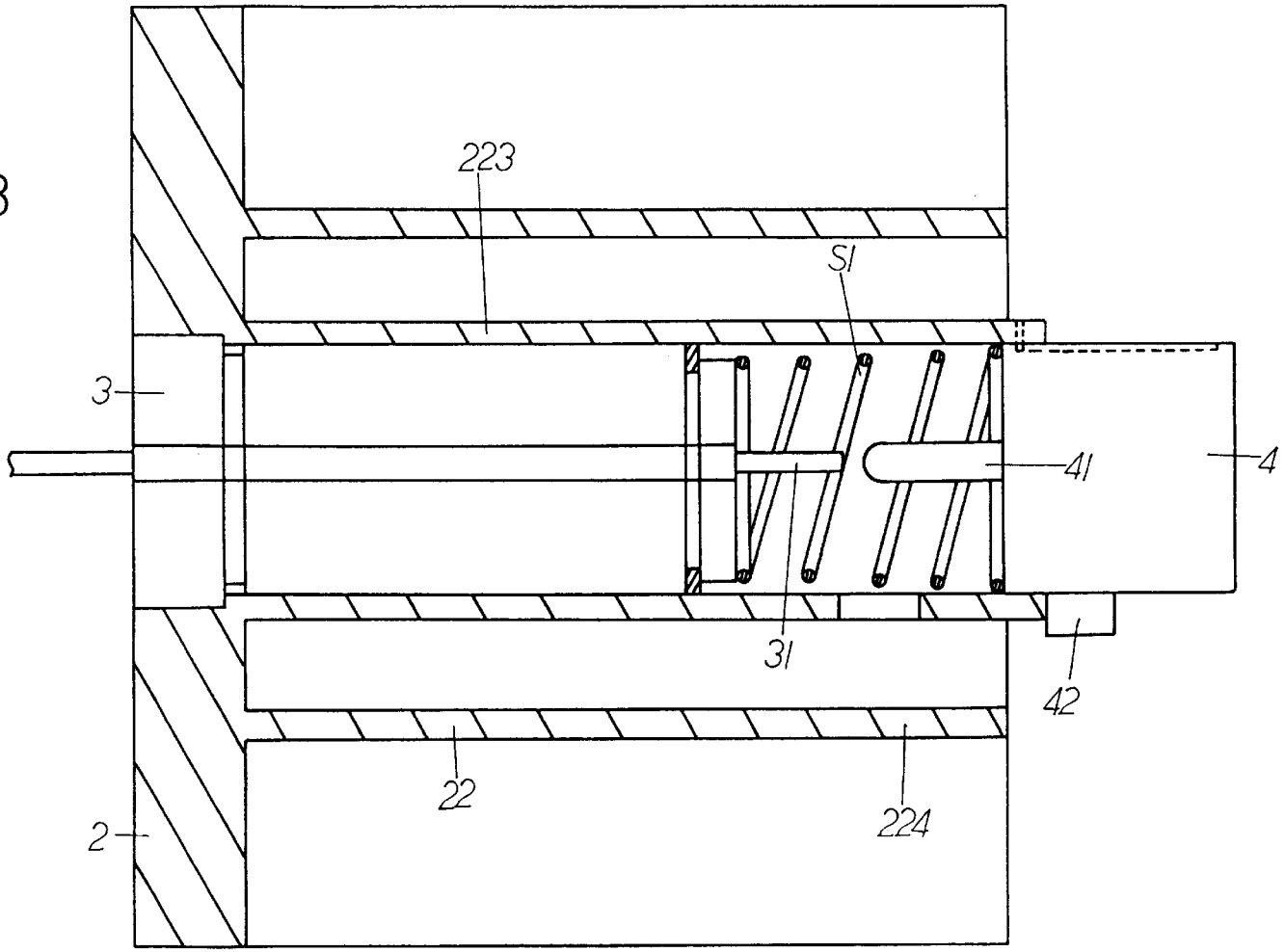
FIG. 4B is a schematic view illustrating an application of a door lock device while the door lock device is unlocked.

When the lateral elastic block 42 disengages from the bottom hole 224, the torsion spring S1 pushes the lateral elastic block 42 to move (as shown in FIG. 4B).

Figure 8:
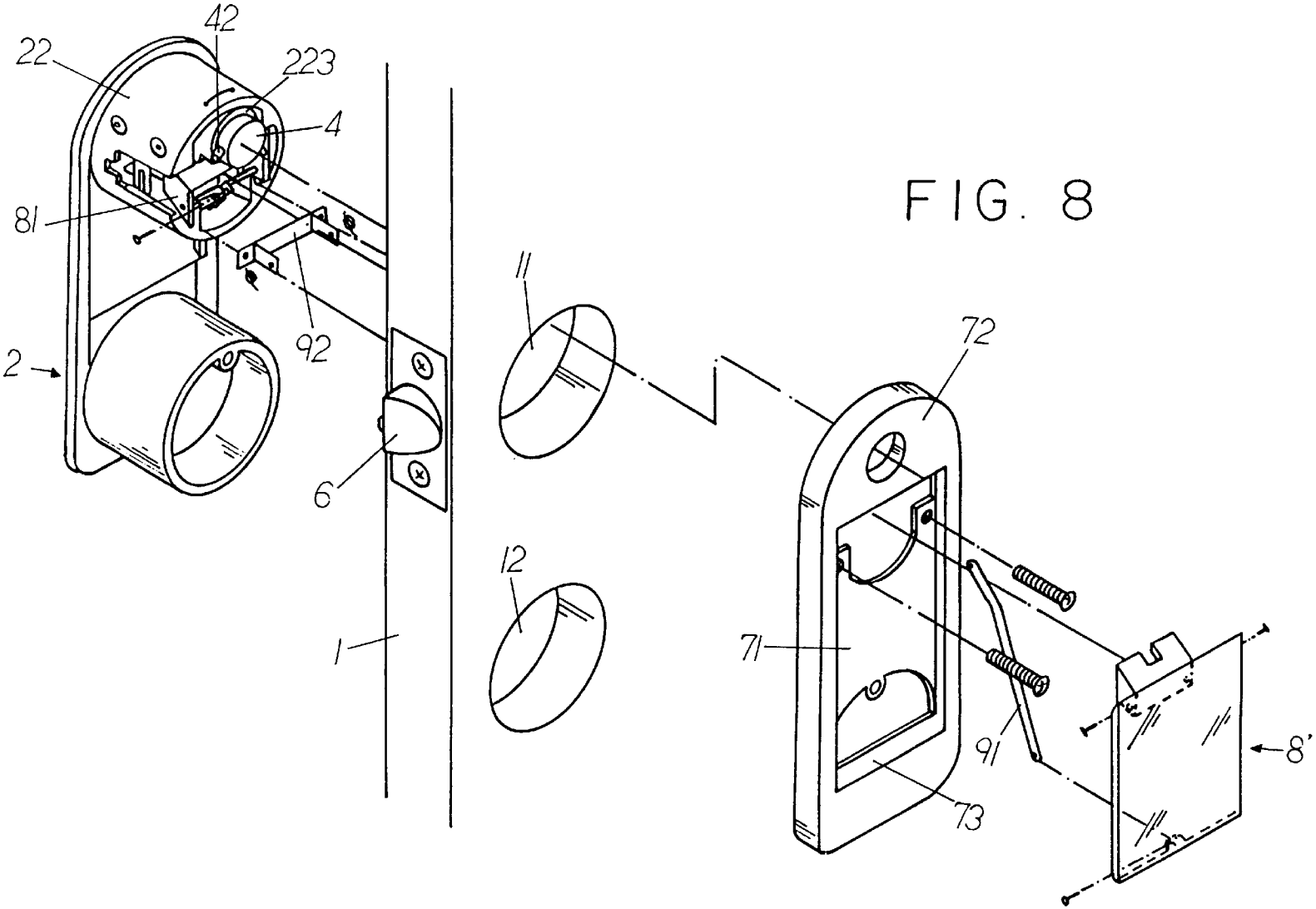
FIG. 8 is a perspective exploded view of a door lock device of another preferred embodiment in accordance with the present invention.
Figure 9:
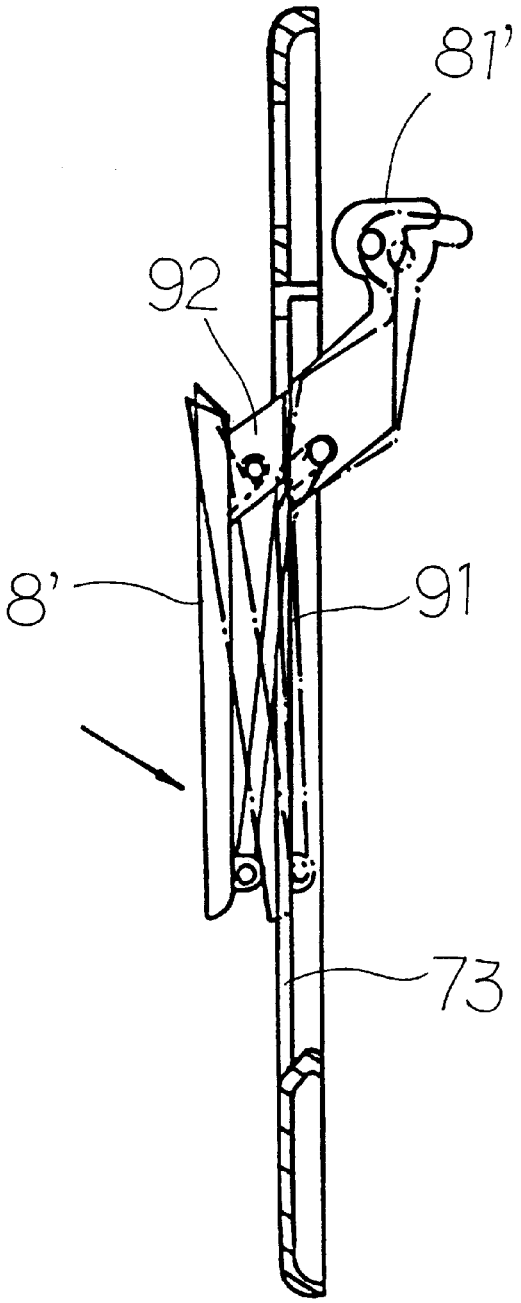
FIG. 9 is a schematic view illustrating an application of a door lock device of another preferred embodiment in accordance with the present invention.
Figure 10:
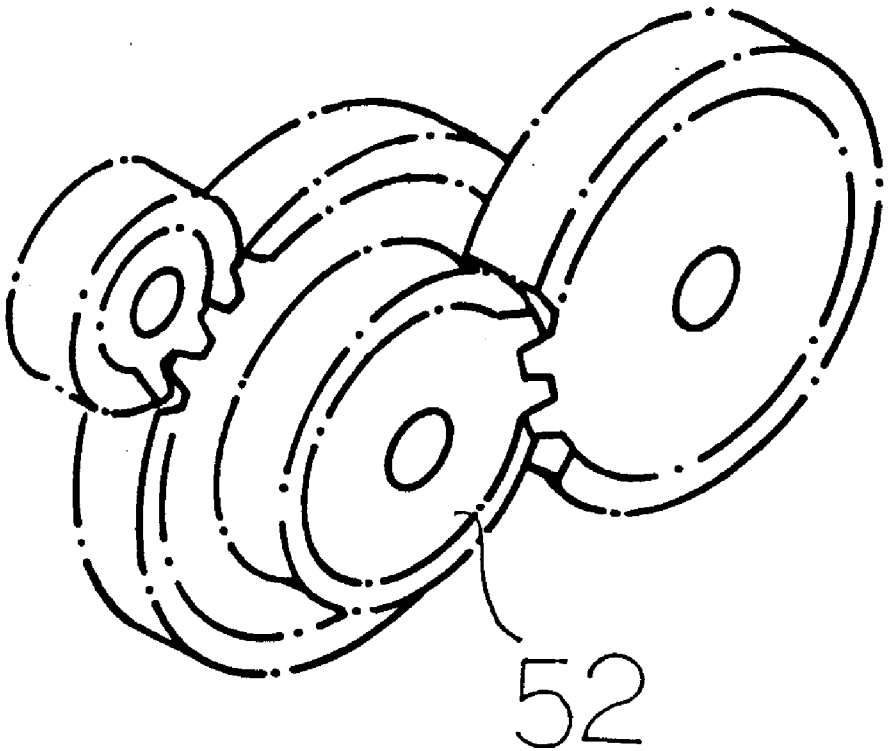
FIG. 10 is a perspective view of a door lock device of the preferred embodiment of the invention.

Referring to FIGS. 8 and 9, a connection frame 92 is disposed between the upper portion of the second pressing plate 8' and the pressing device 81'. A link 91 has a first end connected to the connection frame 92 and a second end connected to the second pressing plate 8'. The user can press the second pressing plate 8' to produce a pressing force.

What is claimed is:

1. A door lock device for a door (1), the door having an upper through hole (11) and a lower through hole (12), the door lock device comprising:

a latch bolt device (6) adapted to be disposed on the door (1);

a case frame (2) having an upper hollow cylinder (22) adapted to be inserted through the upper through hole (11) and a lower hollow cylinder (23) adapted to be inserted through the lower through hole (12);

a first pressing plate (8) disposed on the case frame (2);

a drive mechanism (5) disposed in the upper hollow cylinder (22);

the case frame (2) further comprises a recess (21);

a core (3) has a driven block (31);

a lock fastener device (4) has a lateral elastic block (42) and a blocking bar (41);

the upper hollow cylinder (22) has an inner groove (222), a lateral slot (221), and a core seat (223) receiving the core (3) and the lock fastener device (4);

the core seat (223) has a bottom hole (224);

the drive mechanism (5) has a rack (53) to drive the latch bolt device (6);

a drive frame (51) having a gear set (52) adapted to drive the rack (53);

the rack (53) has an upper groove (532);

the rack (53) passes through the lateral slot (221) to connect to the latch bolt device (6);

a pressing device (81') is disposed in the upper hollow cylinder (22) to connect to the drive frame (51);

the pressing device (81') includes a protruded block (82');

the blocking bar (41) inserted in the upper groove (532);

a compression spring (S) is disposed between the drive frame (51) and the rack (53);

a torsion spring (S1) is disposed between the core (3) and the lock fastener device (4);

the first pressing plate (8) has an upper pressing portion (81);

the recess (21) receives the first pressing plate (8);

a locking plate (71) covers the upper through hole (11) and the lower through hole (12);

a decoration plate (72) is disposed on the locking plate (71);

the decoration plate (72) has an opening (73);

a second pressing plate (8') is disposed on the decoration plate (72); and the opening (73) receives the second pressing plate (8') and an upper portion of the second pressing plate (8') is connected to the pressing device (81').

2. The door lock device as claimed in claim 1, wherein a connection frame (92) is disposed between the upper portion of the second pressing plate (8') and the pressing device (81'), and the door lock device further comprises a link (91) with a first end connected to the connection frame (92) and a second end connected to the second pressing plate (8').

* * * * *